US007710354B2

(12) United States Patent
Yoo

(10) Patent No.: US 7,710,354 B2
(45) Date of Patent: May 4, 2010

(54) PLASMA DISPLAY APPARATUS AND DRIVING METHOD THEREOF

(75) Inventor: Ji-seung Yoo, Yongin-si (KR)

(73) Assignee: LG Electronics Inc., Seoul (KR)

( * ) Notice: Subject to any disclaimer, the term of this patent is extended or adjusted under 35 U.S.C. 154(b) by 1013 days.

(21) Appl. No.: 11/441,190

(22) Filed: May 26, 2006

(65) Prior Publication Data

US 2006/0267870 A1 Nov. 30, 2006

(30) Foreign Application Priority Data

May 30, 2005 (KR) ..... 10-2005-0045417

(51) Int. Cl.
*G09G 3/28* (2006.01)

(52) U.S. Cl. ..... 345/60; 315/169.4

(58) Field of Classification Search ..... None
See application file for complete search history.

(56) References Cited

U.S. PATENT DOCUMENTS 6,356,261 B1 * 3/2002 Kim ..... 345/209
6,411,268 B1 6/2002 Nakamura et al. ..... 345/60
7,501,998 B2 * 3/2009 Heo ..... 345/66
2005/0068264 A1 * 3/2005 Yahagi ..... 345/60

FOREIGN PATENT DOCUMENTS

EP 0 923 066 B1 6/1999
EP 1 434 192 A2 6/2004
KR 10-2001-0004315 A 1/2001

OTHER PUBLICATIONS

European Office Action dated Dec. 13, 2007.
European Search Report dated Aug. 23, 2006.

* cited by examiner

*Primary Examiner*—Alexander Eisen
*Assistant Examiner*—Robin Mishler
(74) *Attorney, Agent, or Firm*—KED & Associates LLP

(57) ABSTRACT

Provided are a plasma display apparatus and a driving method thereof. The apparatus comprises a plasma display panel comprising a plurality of scan electrodes, and a scan driver. The scan driver drives the plurality of scan electrodes, divides the plurality of scan electrodes into a plurality of scan electrode groups, and distinguishes a level of reset pulse supplied to at least one of the plurality of scan electrode groups from a level of reset pulse supplied to the others of the plurality of scan electrode groups.

13 Claims, 10 Drawing Sheets

PLASMA DISPLAY APPARATUS AND DRIVING METHOD THEREOF

This Nonprovisional application claims priority under 35 U.S.C. §119(a) on Patent Application No. 10-2005-0045417 filed in Korea on May 30, 2005, the entire contents of which are hereby incorporated by reference.

BACKGROUND OF THE INVENTION

1. Field of the Invention

The present invention relates to a plasma display apparatus and a driving method thereof.

2. Description of the Background Art

In a plasma display panel generally, barrier rib provided between front panel and rear panel forms one unit cell. Main discharge gas, such as neon (Ne), helium (He), or a combination (Ne+He) of neon and helium, and inertia gas containing a small amount of xenon are filled within each cell. Discharge being executed by high frequency voltage, the inertia gas generates vacuum ultraviolet rays and excites a phosphor provided between the barrier ribs, thereby embodying image.

FIG. 1 illustrates a driving waveform for driving a plasma display panel in a related-art plasma display apparatus.

As shown in FIG. 1, the plasma display panel is driven with a subfield divided into a reset period for initializing all cells, an address period for selecting the cell to be discharged, a sustain period for sustaining discharge of the selected cell, and an erasure period for erasing wall charges within the discharged cell.

In a setup period of a reset period, a ramp-up waveform (Ramp-up) is concurrently applied to all scan electrodes. By the ramp-up waveform, a weak dark discharge is generated within the discharge cells of a whole screen. By a setup discharge, positive wall charges are accumulated on an address electrode and a sustain electrode, and negative wall charges are accumulated on a scan electrode.

In a setdown period, after the supplying of the ramp-up waveform, a ramp-down waveform (Ramp-down), which falls starting from a positive voltage lower than a peak voltage of the ramp-up waveform to a specific voltage level of lower than a ground (GND) level voltage, generates a weak erasure discharge, thereby sufficiently erasing the wall charges excessively formed in the scan electrode. By the setdown discharge, the wall charges of an extent generating a stable address discharge uniformly remain within the cells.

In the address period, a negative scan pulse is sequentially applied to the scan electrodes and at the same time, a positive data pulse is synchronized to the scan pulse and applied to the address electrode. A voltage difference between the scan pulse and the data pulse and a wall voltage generated in the reset period being added, the address discharge is generated within the discharge cell to which the data pulse is applied.

The wall charges of the extent generating the discharge at the time of applying the sustain voltage (Vs) are formed within the cell selected by the address discharge. A positive voltage (Vz) is supplied to the sustain electrode so that a voltage difference from the scan electrode is reduced during the address period and erroneous discharge with the scan electrode is prevented.

In the sustain period, the sustain pulse (Sus) is alternately applied to the scan electrodes and the sustain electrodes. In the cell selected by the address discharge, the wall voltage within the cell and the sustain pulse being added, whenever each sustain pulse is applied, the sustain discharge, that is, a display discharge between the scan electrode and the sustain electrode is generated.

After the sustain discharge is completed, in the erasure period, a voltage of an erasure ramp waveform (Ramp-ers) whose pulse width and voltage level are low is supplied to the sustain electrode, thereby erasing the wall charges remaining within the cells of the whole screen.

In the plasma display panel, the driving waveform is supplied every subfield of the frame.

Meantime, a rising ramp (Ramp-up) supplied to the scan electrode in the reset period is generally equal to a high voltage pulse of about 400 V and thus, an amount of light generated depending on discharge caused by the rising ramp relatively gets larger. Accordingly, luminance in an off state of all the discharge cells of the plasma display panel, that is, a black luminance relatively gets larger, thereby deteriorating a characteristic of contrast.

SUMMARY OF THE INVENTION

Accordingly, the present invention is to solve at least the problems and disadvantages of the background art.

The present invention is to provide a plasma display apparatus and a driving method thereof, for controlling a level of a reset pulse supplied to a scan electrode of a reset period, thereby improving a characteristic of contrast.

To achieve these and other advantages and in accordance with the purpose of the present invention, as embodied and broadly described, there is provided a plasma display apparatus. The apparatus comprises a plasma display panel comprising a plurality of scan electrodes, and a scan driver. The scan driver drives the plurality of scan electrodes, divides the plurality of scan electrodes into a plurality of scan electrode groups, and distinguishes a level of reset pulse supplied to at least one of the plurality of scan electrode groups from a level of reset pulse supplied to the others of the plurality of scan electrode groups.

A method of driving a plasma display apparatus comprising a plurality of scan electrodes comprises dividing the plurality of scan electrodes into a plurality of scan electrode groups, and supplying a different level of reset pulse to at least one of the plurality of scan electrode groups and the others, resectively.

In another aspect of the present invention, there is provided a method of driving a plasma display apparatus comprising a plurality of scan electrodes. The method comprises dividing the plurality of scan electrodes into odd scan electrodes and even scan electrodes, supplying a first reset pulse with a rising ramp voltage to the odd scan electrodes and supplying a second reset pulse with a predetermined positive voltage to the even number scan electrodes in setup period of reset period of one subfield of an odd frame, and supplying the second reset pulse to the odd scan electrodes and supplying the first reset pulse to the even number scan electrodes in setup period of reset period of a subfield corresponding to one subfield among subfields of an even frame that is next frame of the odd frame.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
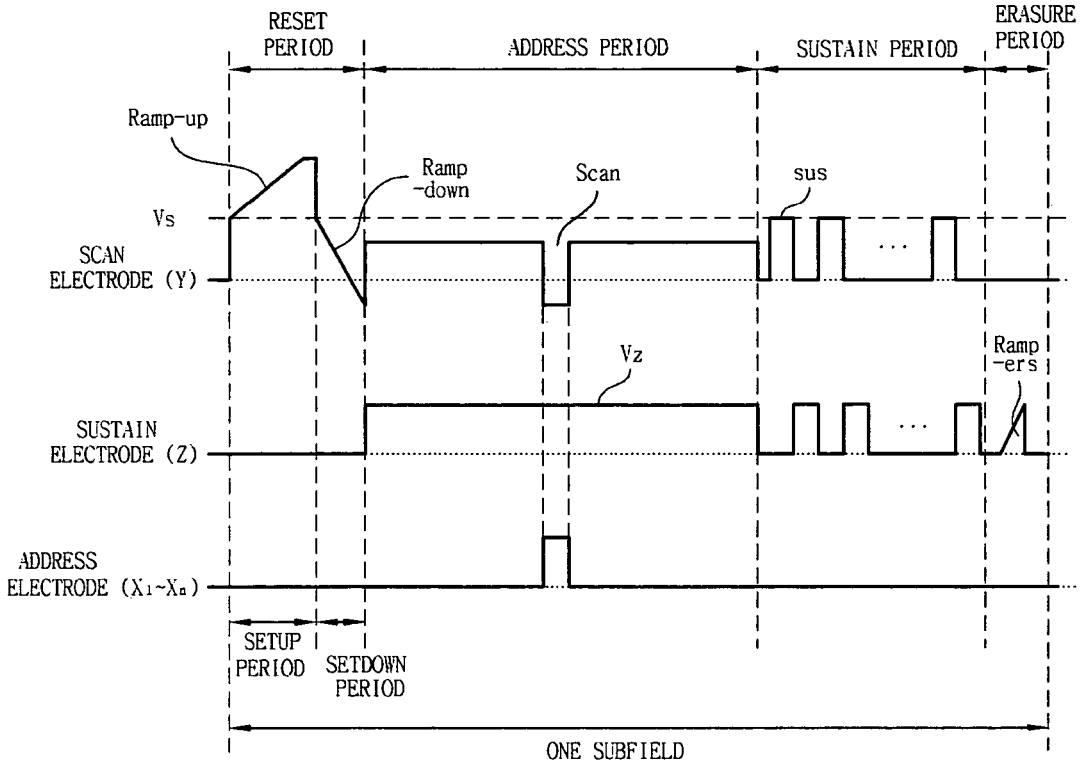
Fig. 1 RELATED ART
FIG. 1 illustrates a driving waveform for driving a plasma display panel in a related art plasma display apparatus.
Figure 2:
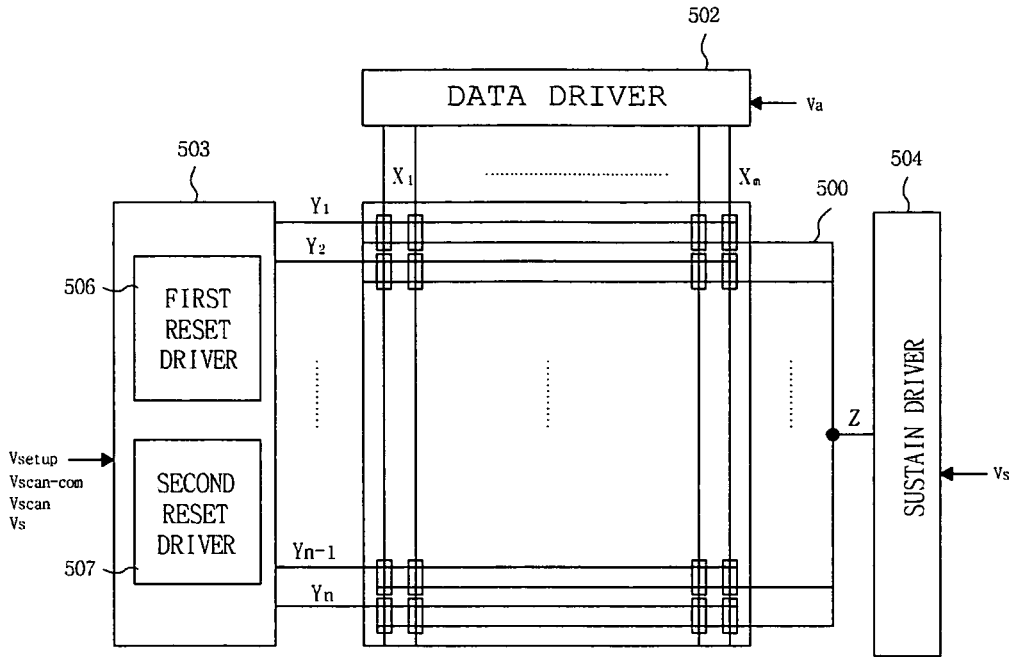
FIG. 2 illustrates a plasma display apparatus according to an exemplary embodiment of the present invention.
Figure 2:
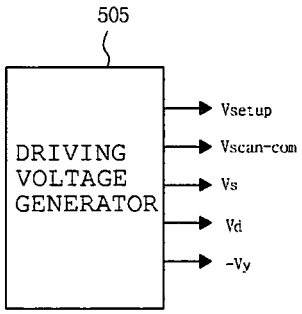

FIG. 2 illustrates a plasma display apparatus according to an exemplary embodiment of the present invention.

As shown in FIG. 2, the plasma display apparatus comprises a plasma display panel 500 comprising a plurality of scan electrodes (Y1 to Yn), a sustain electrode (Z), and a plurality of address electrodes (X1 to Xm); and a scan driver 503 for driving the plurality of scan electrodes (Y1 to Yn), dividing the plurality of scan electrodes (Y1 to Yn) into a plurality of scan electrode groups, and distinguishing a level of a reset pulse supplied to at least one of the plurality of scan electrode groups, from levels of reset pulses supplied to the others of the plurality of scan electrode groups.

The plasma display apparatus comprises the plasma display panel 500 comprising the scan electrodes (Y1 to Yn), the sustain electrode (Z), and the plurality of address electrodes (X1 to Xm); a data driver 502 for supplying data to the address electrodes (X1 to Xm); the scan driver 503 for driving the scan electrodes (Y1 to Yn); a sustain driver 504 for driving the sustain electrode (Z) that is a common electrode; and a driving voltage generator 505 for supplying a necessary driving voltage to each of the drivers 502, 503, and 504.

In the plasma display panel 500, a front panel (not shown) and a rear panel (not shown) are sealed at regular intervals. A plurality of electrodes, for example, a plurality of maintenance electrodes comprising the scan electrodes (Y1 to Yn) and the sustain electrode (Z) are formed. The address electrodes (X1 to Xm) are formed intersecting with the maintenance electrode comprising the scan electrodes (Y1 to Yn) and the sustain electrode (Z).

The data driver 502 receives data that is inverse gamma corrected and error diffused by an inverse gamma correction circuit and an error diffusing circuit not shown) and then is mapped to each sub field by a sub field mapping circuit.

The scan driver 503 supplies a ramp up waveform (ramp-up) and a ramp down waveform (ramp-down) to the scan electrodes (Y1 to Yn) during the reset period. The scan driver 503 sequentially supplies a scan pulse of a scan voltage (−Vy) to the scan electrodes (Y1 to Yn) during an address period, and supplies a sustain pulse to the scan electrodes (Y1 to Yn) during a sustain period.

The scan driver 503 divides the plurality scan electrodes into the plurality of scan electrode groups, and distinguishes the level of the reset pulse supplied to at least one of the scan electrode groups from those of the others of the scan electrode groups in the reset period.

The sustain driver 504 supplies a bias voltage of a sustain voltage (Vs) to the sustain electrodes (Z) during the address period, and alternately operates with the scan driver 503 and supplies the sustain pulse to the sustain electrodes (Z) during the sustain period.

The driving voltage generator 505 generates a setup voltage (Vsetup), a scan common voltage (Vscan-com), the scan voltage (−Vy), the sustain voltage (Vs), and a data voltage (Vd). The driving voltages can be varied depending on a composition of a discharge gas and a discharge cell structure.

The scan driver 503 comprises a first reset driver 506 and a second reset driver 507. The scan driver 503 controls the first and second reset drivers 506 and 507 so that the first reset driver 506 supplies the reset pulses to odd number scan electrode groups of the plurality of scan electrode groups during the reset period, and the second reset driver 507 supplies reset pulses having different levels from the reset pulses supplied to the odd number scan electrode groups, to even number scan electrode groups during the reset period.

In a driving method of the plasma display apparatus according to an exemplary embodiment of the present invention, the plurality of scan electrodes are divided into the plurality of scan electrode groups, and the reset pulses each having a different level are supplied to the scan electrode groups different from at least one of the plurality of scan electrodes groups.

Figure 3:
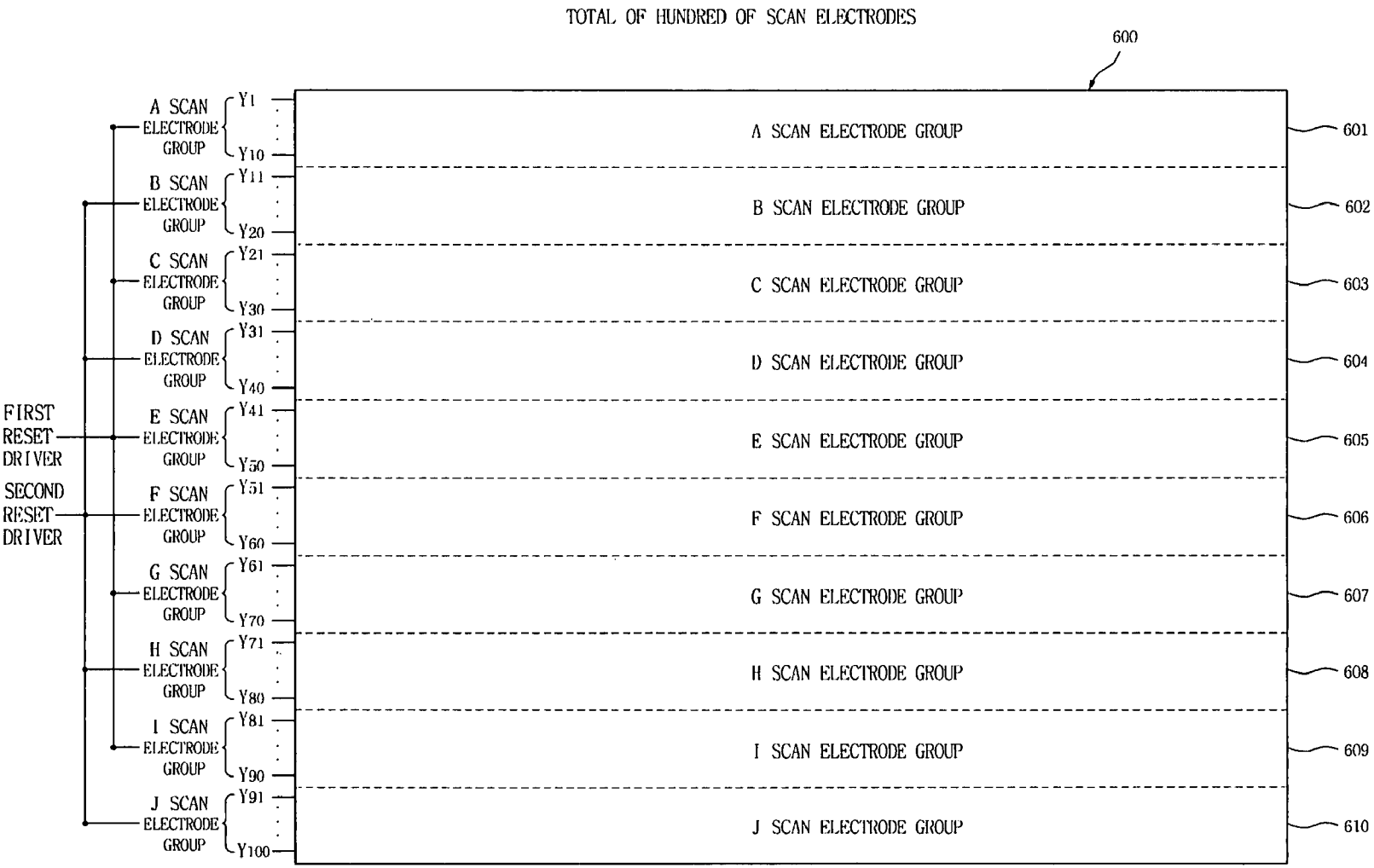
FIG. 3 illustrates a method for dividing a plurality of scan electrodes into a scan electrode group in a plasma display panel according to an exemplary embodiment of the present invention.

FIG. 3 illustrates a method for dividing the plurality of scan electrodes into the scan electrode groups in a plasma display panel according to an exemplary embodiment of the present invention.

As shown in FIG. 3, in the plasma display panel 600, the scan electrodes (Y) are divided into an A scan electrode group 601, a B scan electrode group 602, a C scan electrode group 603, a D scan electrode group 604, an E scan electrode group 605, an F scan electrode group 606, a G scan electrode group 607, an H scan electrode group 608, an I scan electrode group 609, and a J scan electrode group 610.

For example, one hundred scan electrodes being totally formed in the one plasma display panel 600, the scan electrodes ranging from the scan electrode (Y1) to the scan electrode (Y10) are divided into the A scan electrode group 601, and the scan electrodes ranging from the scan electrode (Y11) to the scan electrode (Y20) are divided into the B scan electrode group 602. Like this method, the C scan electrode group 603, the D scan electrode group 604, the E scan electrode group 605, the F scan electrode group 606, the G scan electrode group 607, the H scan electrode group 608, the I scan electrode group 609, and the J scan electrode group 610 are distinguished.

The scan driver 503 of FIG. 2 drives the plurality of scan electrode groups divided as above. For example, the first reset driver 506 of the scan driver 503 supplies the reset pulses to the odd number scan electrode groups, that is, the A, C, E, G, and I scan electrode groups 601, 603, 605, 607, and 609 of the plurality of scan electrode groups during the reset period. The second reset driver 507 supplies the reset pulses to the even number scan electrode groups, that is, the B, D, F, H, and J scan electrode groups 602, 604, 606, 608, and 610 of the plurality of scan electrode groups during the reset period.

The scan electrode group all comprises the scan electrodes of the same number, respectively. The number of the scan electrode groups is at least two and less than the total maximal number of the scan electrodes.

All the scan electrodes comprised in the one scan electrode group are sequential in their scan sequence. In other words, depending on the scan sequence, the scan electrodes of the predetermined number are collected and set as the scan electrode group.

In FIG. 3, the scan electrode groups 601, 602, 603, 604, 605, 606, 607, 608, 609, and 610 comprise ten scan electrodes, respectively, to have same number. But, it is also possible to set the number of the scan electrodes comprised in at least one scan electrode group, different from those of the others of the scan electrode groups. The scan electrode groups are also controllable in number.

Figure 4:
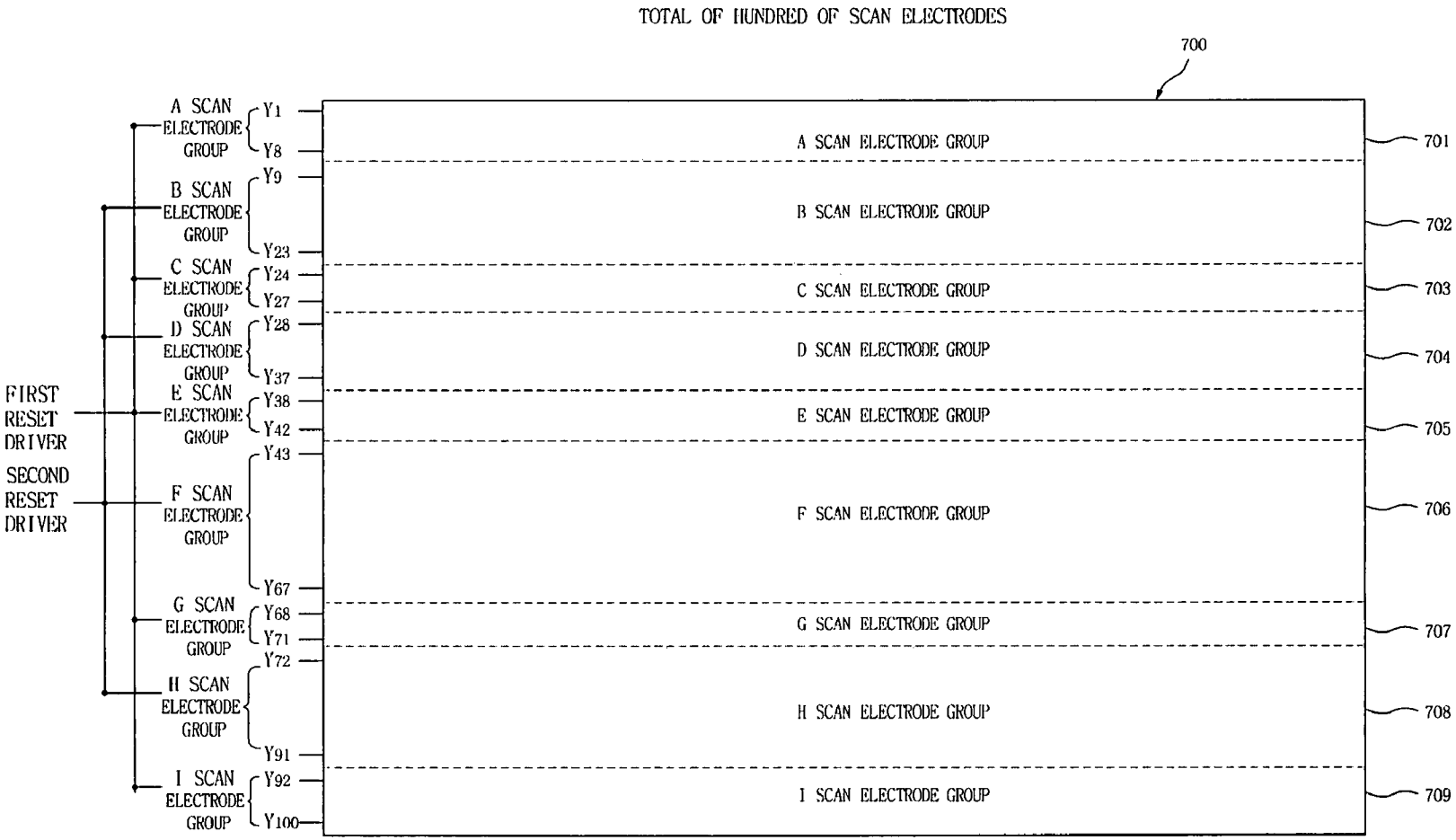
FIG. 4 illustrates a method for dividing scan electrodes formed in a plasma display panel, into scan electrode groups comprising the scan electrodes having different number according to an exemplary embodiment of the present invention.

FIG. 4 illustrates a method for dividing scan electrodes formed in a plasma display panel 700, into scan electrode groups comprising the scan electrodes of different number according to an exemplary embodiment of the present invention.

As shown in FIG. 4, the scan electrodes (Y) are divided into an A scan electrode group 701, a B scan electrode group 702, a C scan electrode group 703, a D scan electrode group 704, an E scan electrode group 705, an F scan electrode group 706, a G scan electrode group 707, an H scan electrode group 708, and an I scan electrode group 709. At least one of the scan electrode groups 701, 702, 703, 704, 705, 706, 707, 708, and 709 comprises the scan electrodes of the number different from those of the others of the scan electrode groups.

All the scan electrodes comprised in the one scan electrode group are sequential in their scan sequence. In other words, depending on the scan sequence, the scan electrodes of the predetermined number are collected and set as the scan electrode group.

The scan driver 503 of FIG. 2 drives the plurality of scan electrode groups divided above. For example, the first reset driver 506 of the scan driver 503 supplies the reset pulses to the odd number scan electrode groups, that is, the A, C, E, G, and I scan electrode groups 701, 703, 705, 707, and 709 of the plurality of scan electrode groups during the reset period. The second reset driver 507 supplies the reset pulses to the even number scan electrode groups, that is, the B, D, F, and H scan electrode groups 702, 704, 706, and 708 of the plurality of scan electrode groups during the reset period.

Figure 5:
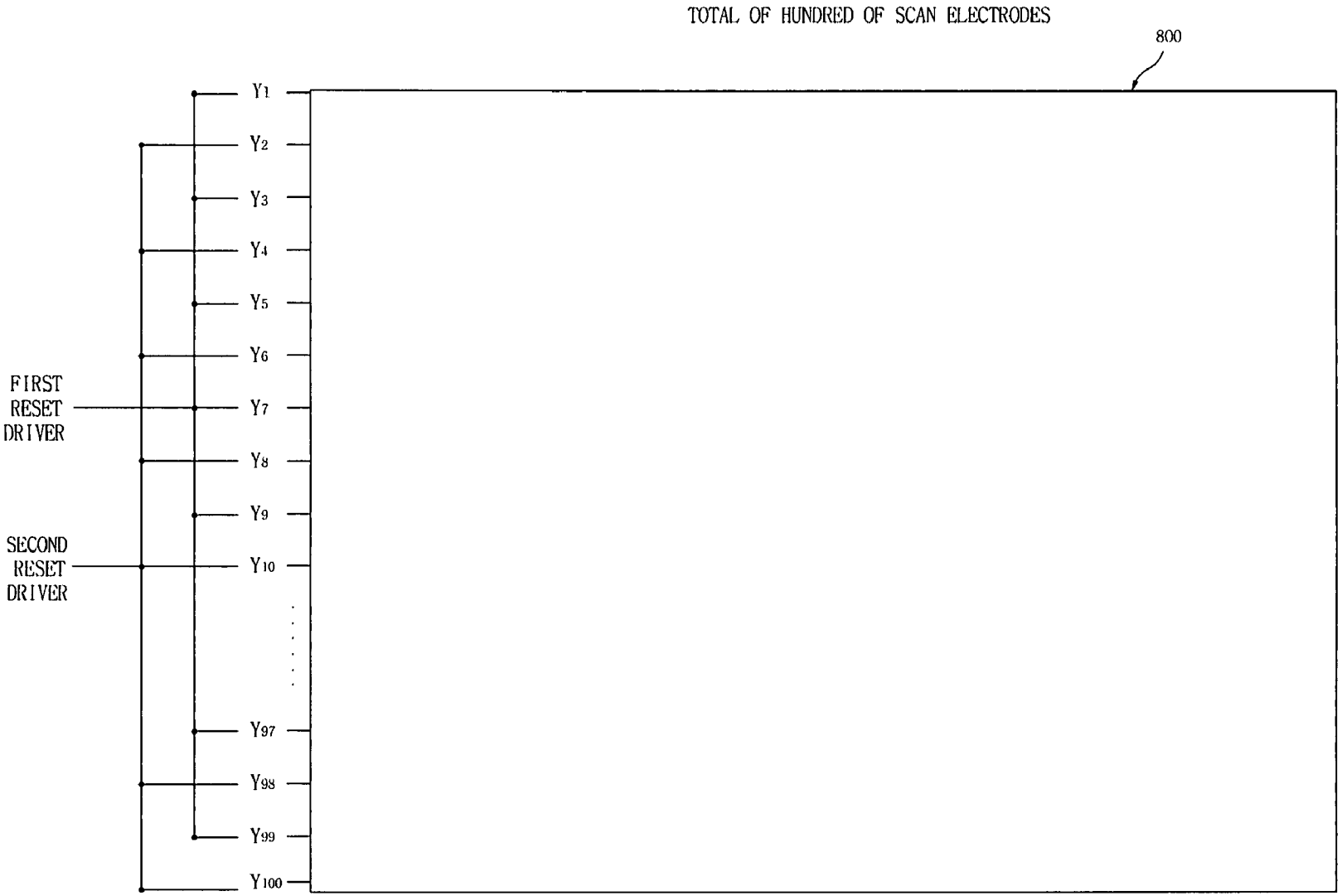
FIG. 5 illustrates a method for dividing scan electrodes formed in a plasma display panel, into scan electrode groups each comprising one scan electrode according to an exemplary embodiment of the present invention.

FIG. 5 illustrates a method for dividing scan electrodes formed in a plasma display panel 800, into scan electrode groups each comprising one scan electrode according to an exemplary embodiment of the present invention.

As shown in FIG. 5, each scan electrode group comprises one scan electrode. The scan driver 503 of FIG. 2 drives a plurality of scan electrode groups. For example, the first reset driver 506 of the scan driver 503 supplies the reset pulses to the odd number scan electrode groups of the plurality of scan electrode groups, and the second reset driver 507 supplies the reset pulses to the even number scan electrode groups of the plurality of scan electrode groups.

Figure 6:
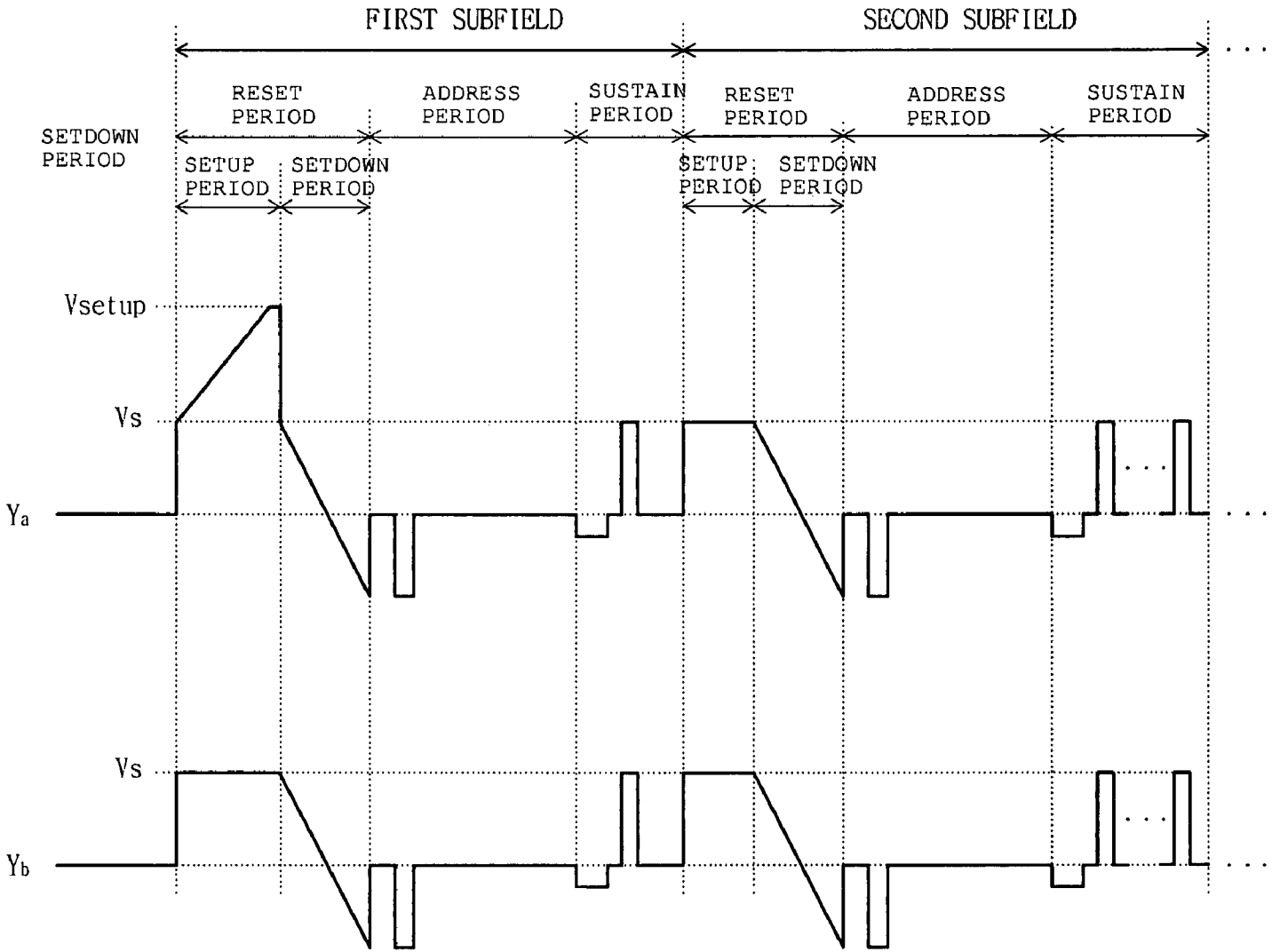
FIG. 6 illustrates a driving method of a plasma display apparatus according to an exemplary embodiment of the present invention.

FIG. 6 illustrates a driving method of a plasma display apparatus according to an exemplary embodiment of the present invention.

As shown in FIG. 6, in the plasma display apparatus of FIG. 2, the plurality of scan electrode groups comprise the first scan electrode group (Ya) and the second scan electrode group (Yb). The scan driver 503 comprises the first reset driver 506 and the second reset driver 507. The first reset driver 506 supplies a first reset pulse equal to a rising ramp voltage to the first scan electrode group (Ya) during the setup period of the reset period of one subfield. The second reset driver 507 supplies a second reset pulse equal to a predetermined positive voltage to the second scan electrode group (Yb) during the setup period of the reset period of the one subfield.

It is possible that the first reset pulse rises from the predetermined positive voltage to the setup voltage, and the second reset pulse is equal to the sustain voltage.

It is possible that the one subfield is equal to a subfield whose weight is the lowest or a subfield whose order in time is the first among subfields of a frame.

The predetermined positive voltage is supplied to the first scan electrode group (Ya) and the second scan electrode group (Yb) in a setup period of a reset period of another subfield that is at least one of subfields with exception of the one subfield.

A maintenance period of a predetermined positive voltage supplied in the setup period of the reset period of another subfield is shorter than a maintenance period of the predetermined positive voltage supplied in the setup period of the reset period of the one subfield.

The reason of being set above is that low weight causing relatively great unstable discharge in a first subfield for embodying low graylevel, the maintenance period of the sustain voltage (Vs) of the reset pulse get longer for stable discharge, thereby getting a distribution of wall charges more uniform within a discharge cell.

As a result, in a subfield with exception of the first subfield, the stable discharge can be guaranteed even though the maintenance period of the sustain voltage (Vs) of the reset pulse is short in length.

As such, the reset pulse comprising a rising ramp is supplied in the setup period of the reset period only in one subfield among the subfields of the frame and thus, a total of the number of the rising ramps within one frame is decreased, thereby improving a characteristic of contrast.

It is desirable that the first reset driver 506 and the second reset driver 507 supply the same reset pulse to all the scan electrodes comprised in the same scan electrode group, in the reset period.

In the driving method of the plasma display apparatus according to an exemplary embodiment of the present invention, the first reset pulse equal to the rising ramp voltage is supplied to the first scan electrode group in the setup period of the reset period of the one subfield, and the second reset pulse equal to the predetermined positive voltage is supplied to the second scan electrode group in the setup period of the reset period of the one subfield.

The first reset pulse rises from the predetermined positive voltage to the setup voltage, and the second reset pulse is equal to the sustain voltage.

The predetermined positive voltage is supplied to the first scan electrode group and the second scan electrode group in the setup period of the reset period of another subfield that is at least one of subfields with exception of the one subfield.

Figure 7:
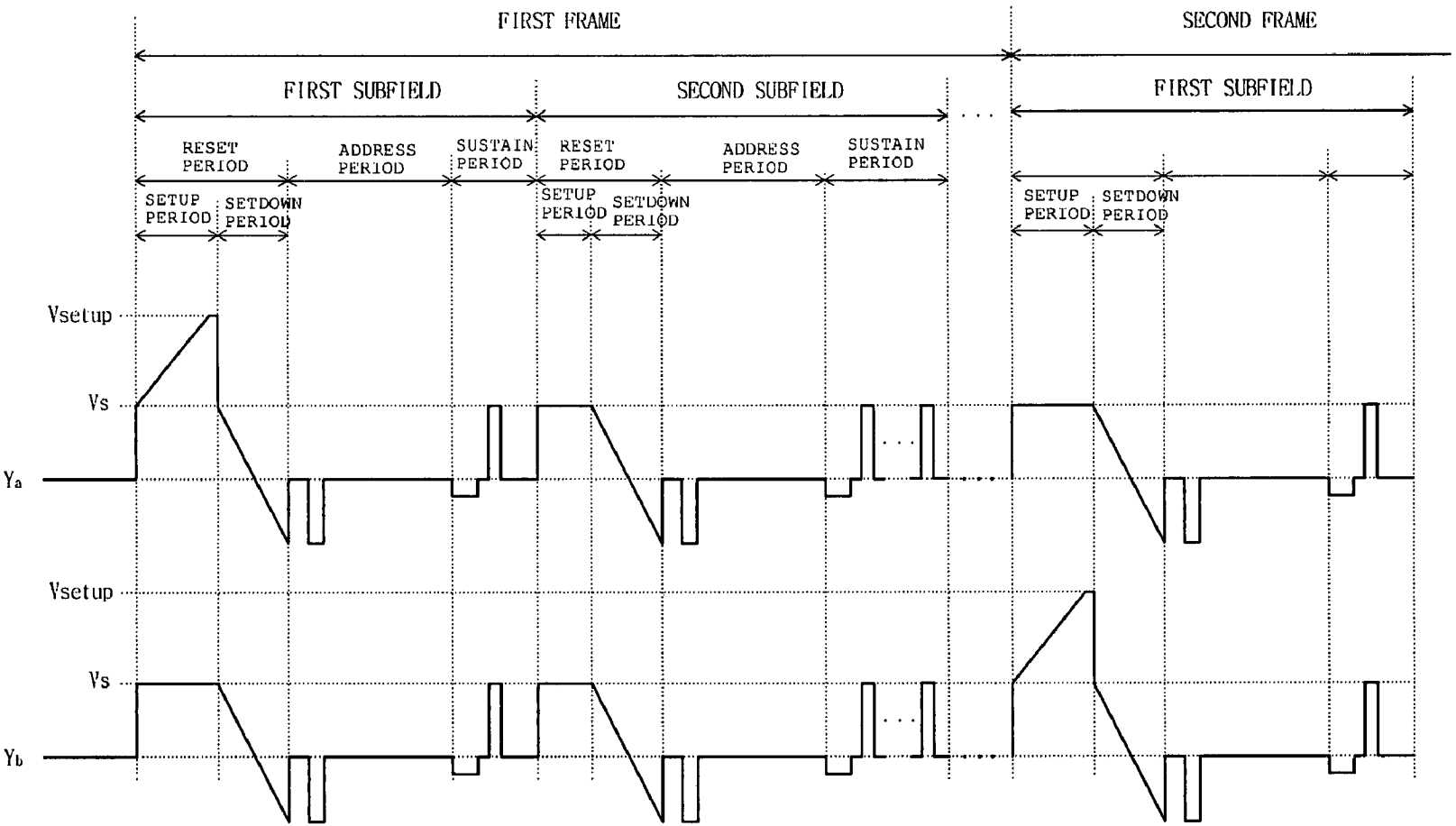
FIG. 7 illustrates a difference between frames of a reset pulse supplied to one scan electrode group in a driving method of a plasma display apparatus according to an exemplary embodiment of the present invention.

FIG. 7 illustrates a difference between the frames of the reset pulse supplied to one scan electrode group in the driving method of the plasma display apparatus according to an exemplary embodiment of the present invention.

As shown in FIG. 7, after the first reset pulse is supplied to the first scan electrode group (Ya) in the setup period of the reset period of the one subfield, the second reset pulse is supplied in a setup period of a reset period of a subfield corresponding to the one subfield among subfields of a next frame. After the second reset pulse is supplied to the second scan electrode group (Yb) in the setup period of the reset period of the one subfield, the first reset pulse is supplied in a setup period of a reset period of a subfield corresponding to the one subfield among subfields of a frame after the next frame.

The first reset driver 506 of FIG. 2 supplying the first reset pulse to the first scan electrode group (Ya) in the first subfield whose weight is the lowest among subfields of one frame, it is possible to supply the second reset pulse in a setup period of a reset period of a first subfield whose weight is the lowest in a next frame.

The reset pulse supplied to the first scan electrode group (Ya) in the setup period of the reset period, and the reset pulse supplied to the second scan electrode group (Yb) in the setup period of the reset period, are alternately supplied to the first scan electrode group (Ya) and the second scan electrode group (Yb) every one frame.

The first reset pulse being sequentially supplied to the first scan electrode group (Ya) and the second reset pulse being sequentially supplied to the second scan electrode group (Yb), the discharge relatively gets unstable in the second scan electrode group (Yb) to which the rising ramp is not supplied, compared to the first scan electrode group (Ya) to which the rising ramp is sequentially supplied. Thus, luminance gets different in the first scan electrode group (Ya) and the second scan electrode group (Yb), thereby deteriorating a picture quality.

In the driving method of the plasma display apparatus according to an exemplary embodiment of the present invention, the plurality of scan electrodes are divided into odd number and even number scan electrodes. In a setup period of a reset period of one subfield of an odd frame, the first reset pulse equal to the rising ramp voltage is supplied to the odd number scan electrodes, and the second reset pulse equal to a predetermined positive voltage is supplied to the even number scan electrodes. In a setup period of a reset period of a subfield corresponding to the one subfield among subfields of an even frame equal to a next frame of the odd frame, the second reset pulse is supplied to the odd number scan electrodes, and the first reset pulse is supplied to the even number scan electrodes.

Figure 8:
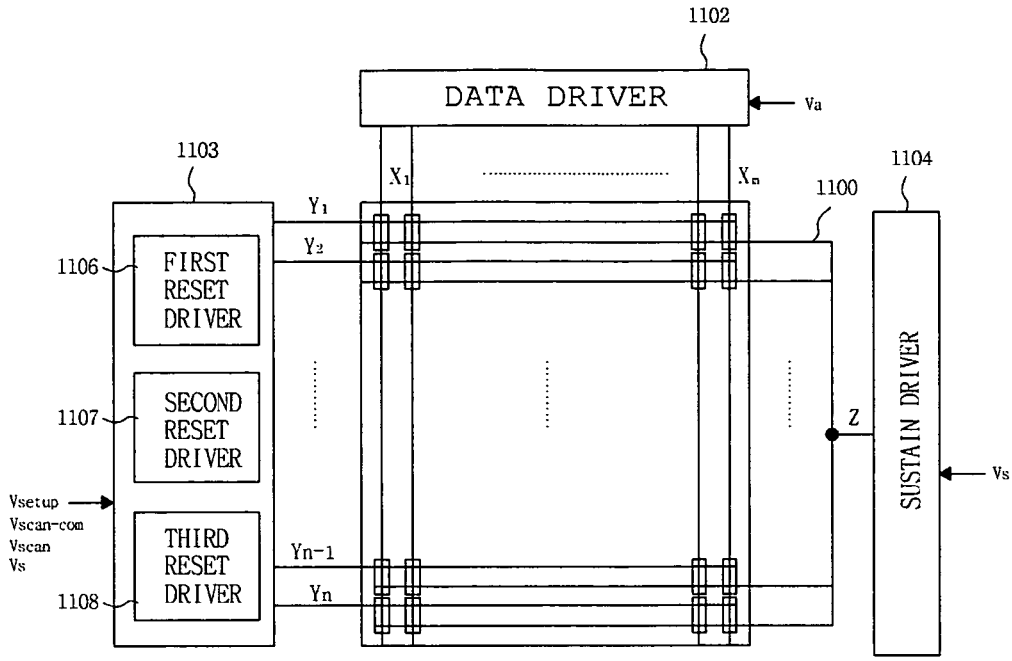
FIG. 8 illustrates a plasma display apparatus according to an exemplary embodiment of the present invention.
Figure 8:
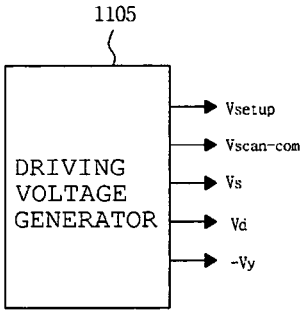

FIG. 8 illustrates a plasma display apparatus according to an exemplary embodiment of the present invention.

As shown in FIG. 8, in the plasma display apparatus, a plurality of scan electrode groups comprise a first scan electrode group, a second scan electrode group, and a third scan electrode group. A scan driver 1103 comprises a first reset driver 1106, a second reset driver 1107, and a third reset driver 1108.

The first reset driver 1106 supplies a first reset pulse rising from a predetermined positive voltage to a setup voltage to the first scan electrode group in a setup period of a reset period of one subfield. The second reset driver 1107 supplies a second reset pulse, which rises from a predetermined positive voltage to a voltage lower than the setup voltage and maintains a voltage lower than the setup voltage for a predetermined time, to the second scan electrode group in the setup period of the reset period of the one subfield. The third reset driver 1108 supplies a third reset pulse equal to a predetermined positive voltage to the third scan electrode group in the setup period of the reset period of the one subfield.

It is possible that the one subfield is equal to a subfield whose weight is the lowest or a subfield whose order in time is the first among subfields of a frame.

The predetermined positive voltage is supplied to the first scan electrode group, the second scan electrode group, and the third scan electrode group in a setup period of a reset period of another subfield that is at least one of subfields with exception of the one subfield. A maintenance period of the predetermined positive voltage supplied in the setup period of the reset period of another subfield is shorter than a maintenance period of the predetermined positive voltage supplied in the setup period of the reset period of the one subfield.

The number of the reset drivers 1106, 1107, and 1108 are shown only three. But, unlike this, it is possible to embody all cases with more than three drivers such as four, five, and six.

Figure 9:
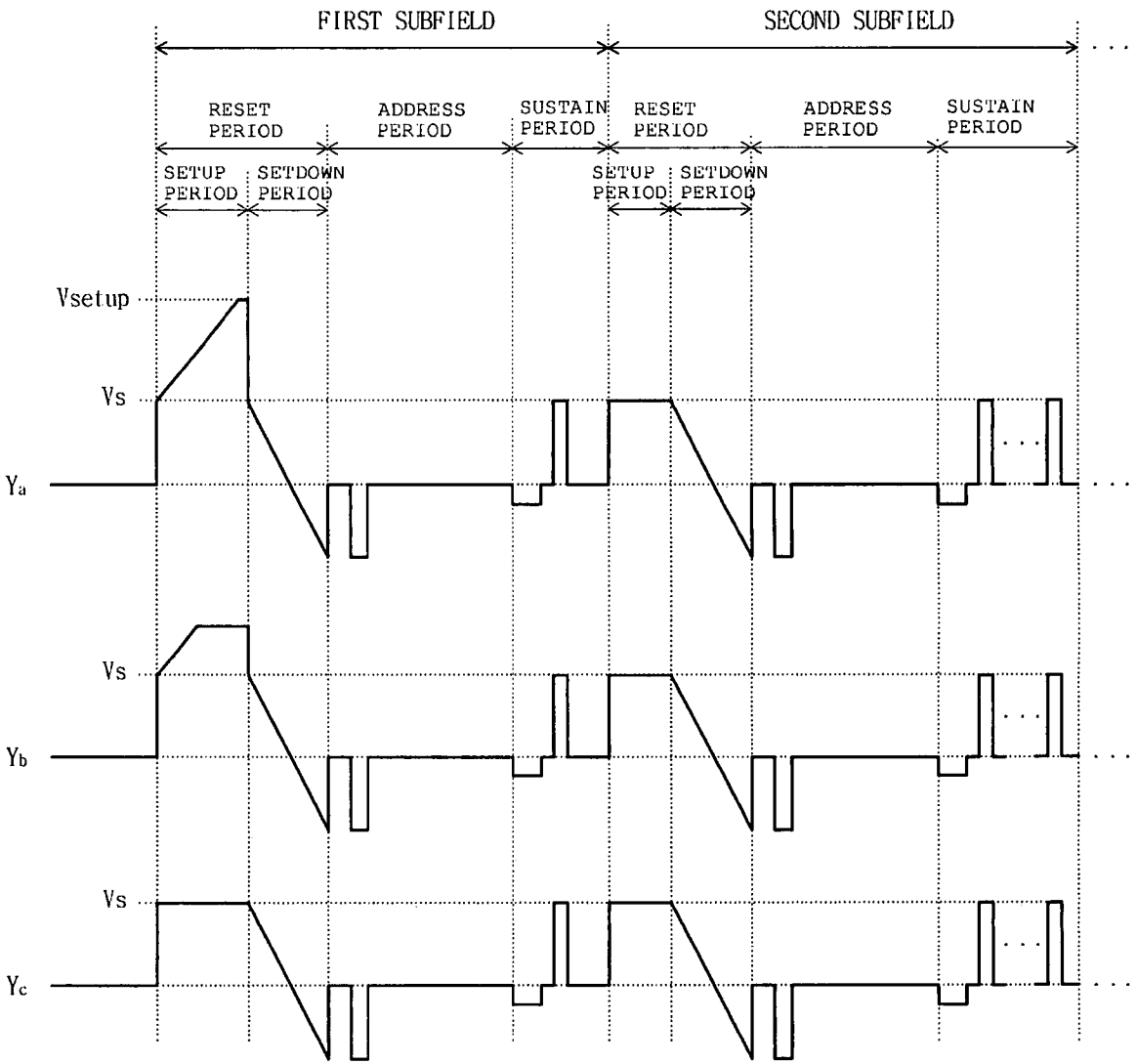
FIG. 9 illustrates a driving method for driving a plasma display panel in the plasma display apparatus of FIG. 8 according to an exemplary embodiment of the present invention.

FIG. 9 illustrates a driving method for driving a plasma display panel in the plasma display apparatus of FIG. 8 according to an exemplary embodiment of the present invention.

As shown in FIG. 9, in the driving method of the plasma display apparatus, the first reset pulse is supplied to the first scan electrode group in the setup period of the reset period of the one subfield, and the second reset pulse is supplied to the second scan electrode group in the setup period of the reset period of the one subfield, and the third reset pulse is supplied to the third scan electrode group in the setup period of the reset period of the one subfield.

As such, only in one subfield among the subfields of the frame, the reset pulse comprising the rising ramp is supplied in the setup period of the reset period to the selected scan electrode groups of a predetermined number and thus, a total of the number of the rising ramps within one frame is decreased, thereby improving a characteristic of contrast.

In a driving waveform of FIG. 9, the first reset pulse is supplied to the first scan electrode group (Ya). The third reset pulse is supplied to the third scan electrode group (Yc). A reset pulse of voltage that is lower than the rising ramp supplied the first scan electrode group (Ya) and is higher than the predetermined positive voltage supplied to the third scan electrode group (Yc) is supplied to the second scan electrode group (Yb) positioned between the first scan electrode group (Ya) and the third scan electrode group (Yc). Thus, a luminance difference between the first scan electrode group (Ya) and the second scan electrode group (Yb) is lower than a luminance difference between the first scan electrode group (Ya) and the second scan electrode group (Yb) shown in the driving waveform of FIG. 6, thereby more improving a picture quality.

It is desirable that the first reset driver 1106, the second reset driver 1107, and the third reset driver 1108 supply the same reset pulse to all scan electrodes comprised in the same scan electrode group, in the reset period.

Figure 10:
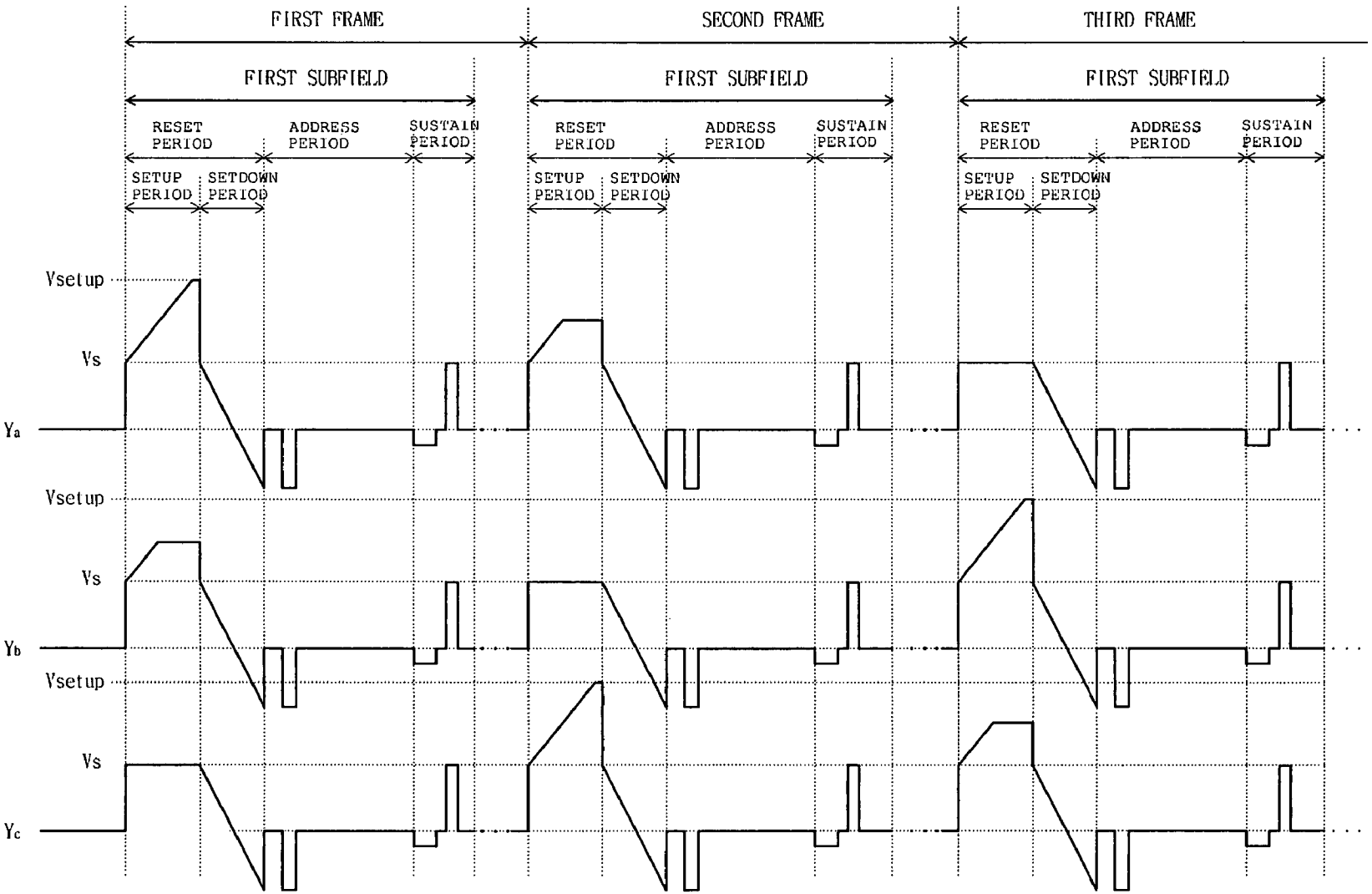
FIG. 10 illustrates a difference between frames of a reset pulse supplied to one scan electrode group in a driving method of a plasma display apparatus according to an exemplary embodiment of the present invention.

FIG. 10 illustrates a difference between the frames of the reset pulse supplied to one scan electrode group in the driving method of the plasma display apparatus according to an exemplary embodiment of the present invention.

As shown in FIG. 10, after the first reset pulse is supplied to the first scan electrode group in the setup period of the reset period of the one subfield, the second reset pulse is supplied in a setup period of a reset period of a subfield corresponding to the one subfield among subfields of a next frame. After the supplying of the second reset pulse, the third reset pulse is supplied in a setup period of a reset period of a subfield corresponding to the one subfield among subfields of a frame after the next frame.

After the second reset pulse is supplied to the second scan electrode group in the setup period of the reset period of the one subfield, the third reset pulse is supplied in a setup period of a reset period of a subfield corresponding to the one subfield among subfields of a next frame. After the supplying of the third reset pulse, the first reset pulse is supplied in a setup period of a reset period of a subfield corresponding to the one subfield among subfields of a frame after the next frame.

After the third reset pulse is supplied to the third scan electrode group in the setup period of the reset period of the one subfield, the first reset pulse is supplied in a setup period of a reset period of a subfield corresponding to the one subfield among subfields of a next frame. After the supplying of the first reset pulse, the second reset pulse is supplied in a setup period of a reset period of a subfield corresponding to the one subfield among subfields of a frame after the next frame.

As shown in FIG. 10, the reset pulse supplied to the first scan electrode group (Ya) in the setup period of the reset period, the reset pulse supplied to the second scan electrode group (Yb) in the setup period of the reset period, and the reset pulse supplied to the third scan electrode group (Yc) in the setup period of the reset period are alternately supplied to the first scan electrode group (Ya), the second scan electrode group (Yb), and the third scan electrode group (Yc) every frame.

The present invention has an effect of distinguishing the level of the voltage of the reset pulse supplied to the scan electrode group comprising one or more scan electrodes in the setup period of the reset period of one or more subfields of one frame, from those of the others of the scan electrode groups, thereby improving the contrast characteristic.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising: a plasma display panel comprising a plurality of scan electrodes arranged to be driven in groups; and a scan driver for driving the plurality of scan electrode groups, and for distinguishing a level of a reset pulse supplied to at least one of the plurality of scan electrode groups from a level of a reset pulse supplied to one or more others ones of the plurality of scan electrode groups, wherein the scan driver comprises a first reset driver, a second reset driver, and a third reset driver and wherein the plurality of scan electrode groups comprise a first scan electrode group, a second scan electrode group, and a third scan electrode group, and wherein:

the first reset driver supplies a first reset pulse rising from a first predetermined positive voltage to a setup voltage to the first scan electrode group in a setup period of a reset period of one subfield, the second reset driver supplies a second reset pulse rising from a second predetermined positive voltage to a voltage lower than the setup voltage and maintains the voltage lower than the setup voltage for a predetermined time to the second scan electrode group in the setup period of the reset period of said one subfield, the third reset driver supplies a third reset pulse with a third predetermined positive voltage to the third scan electrode group in the setup period of the reset period of said one subfield, and wherein:

the first reset pulse is supplied to the first scan electrode group in the setup period of the reset period of said one subfield in a first frame, and then the second reset pulse is supplied to the first scan electrode group in a setup period of a reset period of a subfield corresponding to said one subfield in a second frame, and then the third reset pulse is supplied to the first scan electrode group in a setup period of a reset period of a subfield corresponding to said one subfield in a third frame, the second reset pulse is supplied to the second scan electrode group in the setup period of the reset period of said one subfield in the first frame, and then the third reset pulse is supplied to the second scan electrode group in the setup period of the reset period of the subfield corresponding to said one subfield in the second frame, and then the first reset pulse is supplied to the second scan electrode group in the setup period of the reset period of the subfield corresponding to said one subfield in the third frame, and the third reset pulse is supplied to the third scan electrode group in the setup period of the reset period of said one subfield in the first frame, and then the first reset pulse is supplied to the third scan electrode group in the setup period of the reset period of the subfield corresponding to said one subfield in the second frame, and then the second reset pulse is supplied to the third scan electrode group in the setup period of the reset period of the subfield corresponding to said one subfield in the third frame.

2. The plasma display apparatus of claim 1, wherein each of the plurality of scan electrode groups comprises a same number of scan electrodes.

3. The plasma display apparatus of claim 1, wherein a number of the plurality of scan electrode groups ranges from two to a total number of the scan electrodes in the panel.

4. The plasma display apparatus of claim 1, wherein a number of the scan electrodes in at least one of the plurality of scan electrode groups is different from a number of scan electrodes in another one of the plurality of scan electrode groups.

5. A method of driving a plasma display apparatus comprising a plurality of scan electrodes, the method comprising:

dividing the plurality of scan electrodes into a plurality of scan electrode groups; and supplying a different level of reset pulse to at least one of the plurality of scan electrode groups and the others, respectively, wherein the scan driver comprises a first reset driver, a second reset driver, and a third reset driver and wherein the plurality of scan electrode groups comprise a first scan electrode group, a second scan electrode group, and a third scan electrode group, and wherein:

the first reset driver supplies a first reset pulse rising from a first predetermined positive voltage to a setup voltage to the first scan electrode group in a setup period of a reset period of one subfield, the second reset driver supplies a second reset pulse rising from a second predetermined positive voltage to a voltage lower than the setup voltage and maintains the voltage lower than the setup voltage for a predetermined time to the second scan electrode group in the setup period of the reset period of said one subfield, the third reset driver supplies a third reset pulse with a third predetermined positive voltage to the third scan electrode group in the setup period of the reset period of said one subfield, and wherein the first reset pulse is supplied to the first scan electrode group in the setup period of the reset period of said one subfield in a first frame, and then the second reset pulse is supplied to the first scan electrode group in a setup period of a reset period of a subfield corresponding to said one subfield in a second frame, and then the third reset pulse is supplied to the first scan electrode group in a setup period of a reset period of a subfield corresponding to said one subfield in a third frame, the second reset pulse is supplied to the second scan electrode group in the setup period of the reset period of said one subfield in the first frame, and then the third reset pulse is supplied to the second scan electrode group in the setup period of the reset period of the subfield corresponding to said one subfield in the second frame, and then the first reset pulse is supplied to the second scan electrode group in the setup period of the reset period of the subfield corresponding to said one subfield in the third frame, and the third reset pulse is supplied to the third scan electrode group in the setup period of the reset period of said one subfield in the first frame, and then the first reset pulse is supplied to the third scan electrode group in the setup period of the reset period of the subfield corresponding to said one subfield in the second frame, and then the second reset pulse is supplied to the third scan electrode group in the setup period of the reset period of the subfield corresponding to said one subfield in the third frame.

6. The plasma display apparatus of claim 1, wherein the first, second, and third predetermined positive voltages are substantially a same voltage.

7. The plasma display apparatus of claim 1, wherein the first reset pulse is applied to the first scan electrode group, the second reset pulse is applied to the second scan electrode group, and the third reset pulse is applied to the third scan electrode group in the setup period of the reset period of said for substantially a same period of time in the setup period of the reset period of said one subfield in the first frame.

8. The plasma display apparatus of claim 7, wherein the second and third reset pulses are applied to the first scan electrode group in the second and third frames, respectively, for periods of time that correspond to substantially said same period of time in the setup period of the reset period in the first frame.

9. The plasma display apparatus of claim 8, wherein substantially said same period of time in the first frame corresponds to substantially all the setup period in the reset period in said one subfield in the first frame.

10. The method of claim 5, wherein the first, second, and third predetermined positive voltages are substantially a same voltage.

11. The method of claim 5, wherein the first reset pulse is applied to the first scan electrode group, the second reset pulse is applied to the second scan electrode group, and the third reset pulse is applied to the third scan electrode group in the setup period of the reset period of said for substantially a same period of time in the setup period of the reset period of said one subfield in the first frame.

12. The method of claim 11, wherein the second and third reset pulses are applied to the first scan electrode group in the second and third frames, respectively, for periods of time that correspond to substantially said same period of time in the setup period of the reset period in the first frame.

13. The method of claim 12, wherein substantially said same period of time in the first frame corresponds to substantially all the setup period in the reset period in said one subfield in the first frame.

* * * * *